United States Patent [19]

Van Steenwyk

[11] 4,199,869

[45] Apr. 29, 1980

[54] MAPPING APPARATUS EMPLOYING TWO INPUT AXIS GYROSCOPIC MEANS

[75] Inventor: Donald H. Van Steenwyk, San Marino, Calif.

[73] Assignee: Applied Technologies Associates, San Marino, Calif.

[21] Appl. No.: 970,625

[22] Filed: Dec. 18, 1978

[51] Int. Cl.[2] ..... G01C 9/00

[52] U.S. Cl. ..... 33/302; 33/304; 33/313; 33/324

[58] Field of Search ..... 33/304, 312, 313, 324, 33/302

[56] References Cited

U.S. PATENT DOCUMENTS

| | | | |
|---|---|---|---|
| 3,587,176 | 6/1971 | Schnerb | 33/313 X |
| 3,753,296 | 8/1973 | Van Steenwyk | 33/324 X |
| 3,791,043 | 2/1974 | Russell | 33/312 |

*Primary Examiner*—William D. Martin, Jr.

*Attorney, Agent, or Firm*—William W. Haefliger

[57] ABSTRACT

Mapping apparatus comprises:

(a) a gyroscope and a carrier frame therefor, (b) the gyroscope characterized as having a spinning rotor and torsion structure defining a gimbal, and wherein the rotor spin frequency has a predetermined relation to a resonant frequency of said structure, (c) the gyroscope further characterized as having two input axes, and an output axis about which the spin rotor rotates, (d) drive means operatively connected with said frame to rotate the frame about one of said axis, and (e) the gyroscope having means to detect rotor pivoting about one of said two input axes in response to said rotation of the frame.

A second gyroscope may be employed, with its frame. rotated by the same drive means; and the output axes of the two gyroscopes are typically orthogonally related.

37 Claims, 10 Drawing Figures

MAPPING APPARATUS EMPLOYING TWO INPUT AXIS GYROSCOPIC MEANS

BACKGROUND OF THE INVENTION

This invention relates generally to mapping apparatus and methods, and more particularly concerns well mapping employing a probe which may be inserted into a bore-hole or well. In addition, it concerns method and apparatus to determine the probe's degree of tilt from vertical and to relate the latter to gyroscope generated azimuth information, at all latitudes and at all instrument attitudes. Further, the azimuth determining apparatus by itself or in combination with the tilt measuring apparatus, may be housed in a carrier of sufficiently small diameter to permit insertion directly into available small I.D. drill tubing, thus eliminating the need to remove the tubing to enable such mapping.

In the past, the task of position mapping a well or bore-hole for azimuth in addition to tilt has been excessively complicated, very expensive, and often inaccurate because of the difficulty in accommodating the size and special requirements of the available instrumentation. For example, magnetic compass devices typically require that the drill tubing be pulled from the hole and fitted with a length of non-magnetic tubing close to the drill head; or, the drill stem may be fitted with a few tubular sections of non-magnetic material, either initially or when drill bits are changed. The magnetic compass device is inserted within this non-magnetic section and the entire drill stem reassembled and run back in the hole as measurements are made. Thereafter, the magnetic compass instrumentation package must again be removed, requiring another round trip of the drill string. These devices are very inaccurate where drilling goes through magnetic materials, and are unusable where casing has been installed.

Directional or free gyroscopes are deployed much as the magnetic compass devices and function by attempting to remember a pre-set direction in space as they are run in the hole. Their ability to remember degrades with time and environmental exposure. Also, their accuracy is reduced as instrument size is reduced, as for example becomes necessary for small well bores. Further, the range of tilt and azimuthal variations over which they can be used is restricted by gimbal freedom which must be limited to prevent gimbal lock and consequent gyro tumbling.

A major advance toward overcoming these problems is described in my U.S. Pat. No. 3,753,296. That invention provides a method and means for overcoming the above complications, problems, and limitations by employing that kind and principal of a gyroscope known as rate-of-turn gyroscope, or commonly 'a rate gyro', to remotely determine a plane containing the earth's spin axis (azimuth) while inserted in a bore-hole or well. The rate gryoscope has a rotor defining a spin axis; and means to support the gyroscope for travel in a bore-hole and to rotate about another axis extending in the direction of the hole, the gyroscope characterized as producing an output which varies as a function of azimuth orientation of the gyroscope relative to the earth's spin axis. Such means typically includes a carrier containing the gyroscope and a motor, the carrier being sized for travel in the well, as for example within the drill tubing. Also, circuitry is operatively connected with the motor and carrier to produce an output signal indicating azimuthal orientation of the rotating gyroscope relative to the carrier, whereby that signal and the gyroscope output may be processed to determine azimuth orientation of the carrier and any other instrument therein relative to the earth's spin axis, such instrument for example comprising a well logging device such as a radiometer, inclinometer, etc.

While the device disclosed in that patent is highly useful, it lacks the unusual features and advantages of the present invention, among which are the obtaining of a very high degree of accuracy as respects derived azimuth and tilt information for all latitudes and angularities of bore-holes; the application of one or more two-degree of freedom gyroscopes as a "rate gyro" or rate gyros, for use in well mapping; the use of two such gyros in different attitudes to obtain cross-check azimuth information; and the provision of highly compact instrumentation which is especially needed for smaller diameter bore-holes.

SUMMARY OF THE INVENTION

It is a major object of the invention to provide method and apparatus facilitating the above described advantages. In one form, the apparatus comprises:

(a) a gyroscope and a carrier frame therefor, (b) the gyroscope characterized as having a spinning rotor and torsion structure defining a gimbal, and wherein the rotor spin frequency has a predetermined relation to a resonant frequency of said structure, (c) the gyroscope further characterized as having two input axes, and an output axis about which the spin rotor rotates, (d) drive means operatively connected with said frame to rotate the frame about one of said axes, and (e) the gyroscope having means to detect rotor pivoting about one of said two input axes in response to said rotation of the frame.

As will be seen, the frame may be rotated about the output axis by the drive means (such as a motor); and in another form of the invention the frame is rotated about one of the input axes by the drive means. Also, a tilt sensitive device such as an accelerometer is typically associated with the gyroscope to be rotated in conjunction with rotation of the gyro carrier frame, to produce an output which varies as a function of the frame rotation and of tilt thereof from vertical. Further, the gyro may include a spin motor to rotate the rotor, and the torsion structure typically includes mutually orthogonally extending primary and secondary torsion members through which rotation is transmitted to the rotor, those members defining the two input axes. Pick-offs and torque motors are typically employed, respectively to sense gimbaling of the spinning rotor (in response to frame rotation about the described one axis) and to apply selectively torque to the two-axis rotor so as to convert it to a single degree of freedom rotor (i.e. to block gimbaling about one of the two input axes).

It is another object of the invention to provide modified instrumentation whereas two such "tuned rotor" gyroscopes are employed, the first having its output axis parallel to the one axis about which the carrier frame is rotated, and the second having its output axis normal to said one axis. Both gyros are mounted to be simultaneously rotated about said one axis, the result being that an all attitude, all latitude instrument is provided, with very useful confirmatory azimuth information being produced. Further, should one gyro fail, the other will normally provide usable information.

These and other objects and advantages of the invention, as well as the details of illustrative embodiments, will be more fully understood from the following description and drawings, in which:

DRAWING DESCRIPTION

Figure 1:
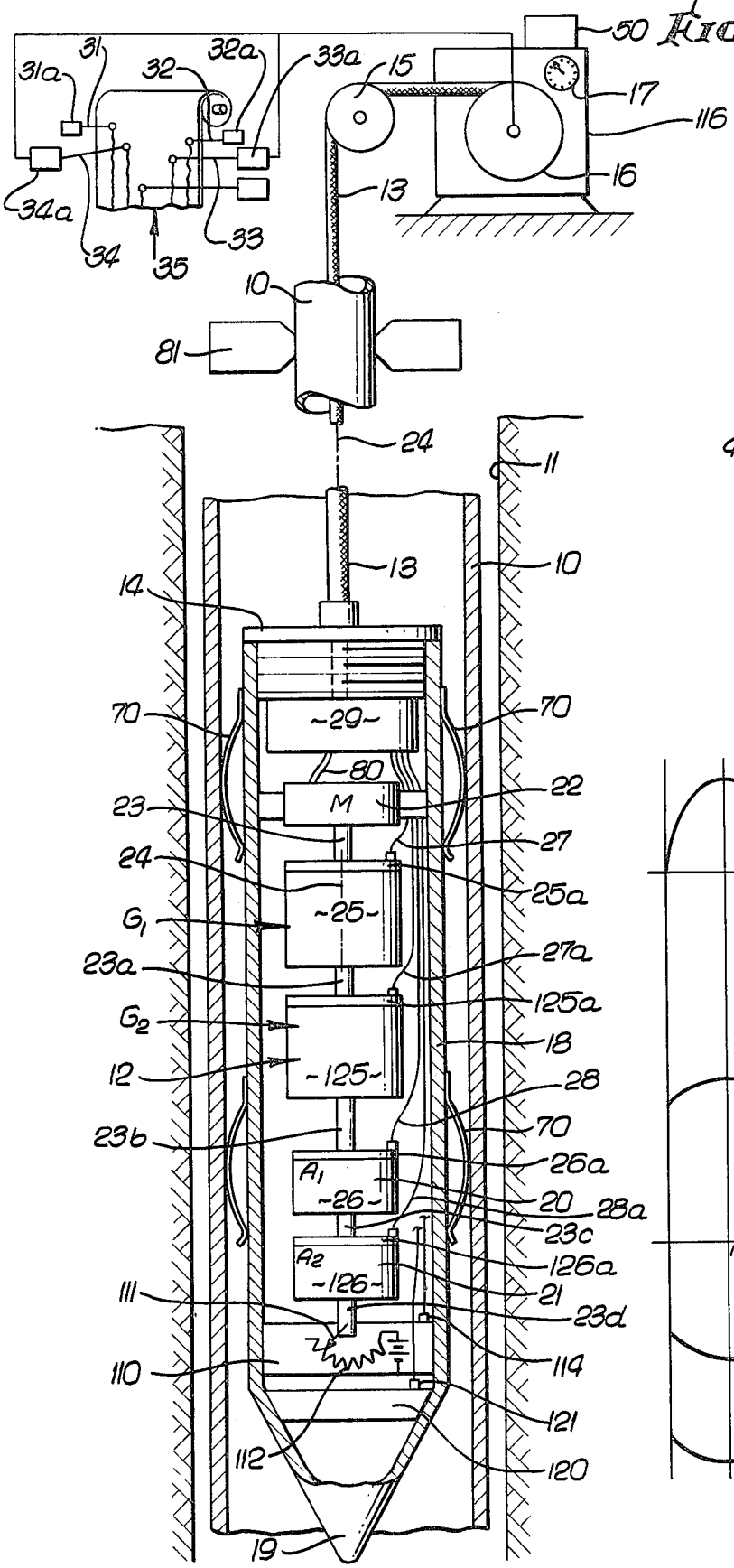
FIG. 1 is an elevation taken in section to show use of one form of instrument of the invention, in well mapping.
Figure 4:
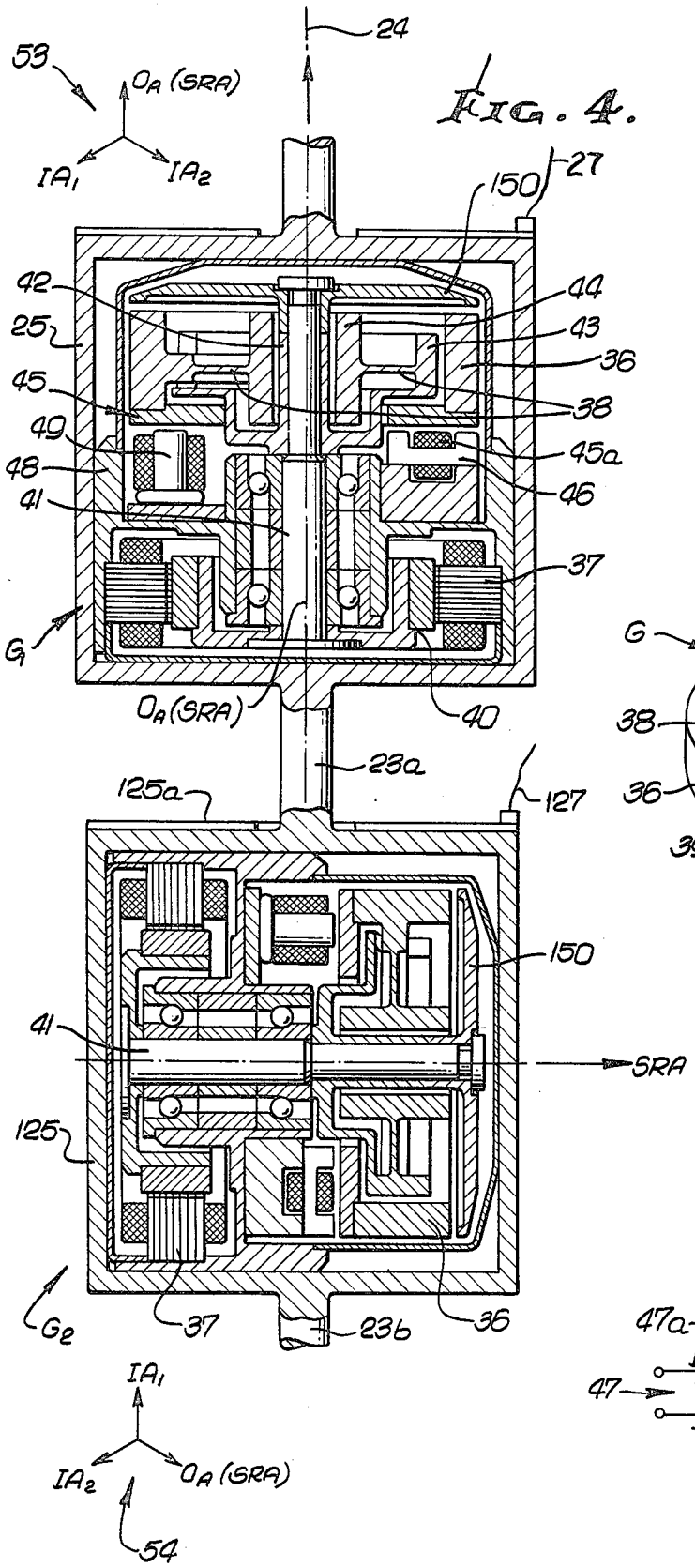
FIG. 4 is an enlarged vertical section showing details of two gyrocompasses as may be used in the apparatus of FIG. 1.
Figure 4A:
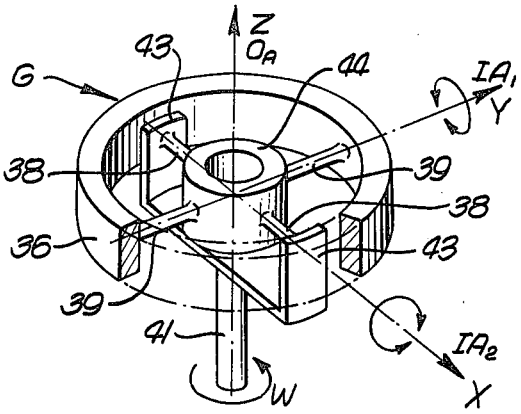
Figure 4B:
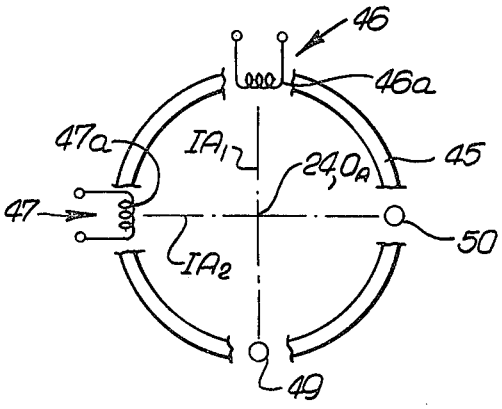
Figure 5:
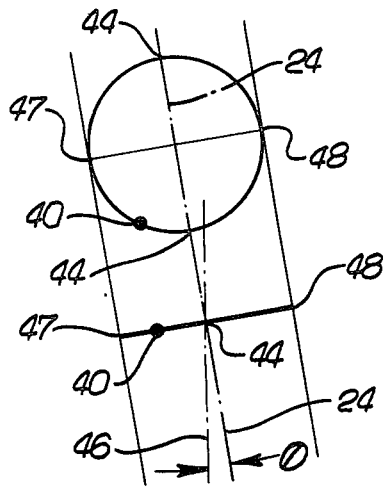
Figure 6:
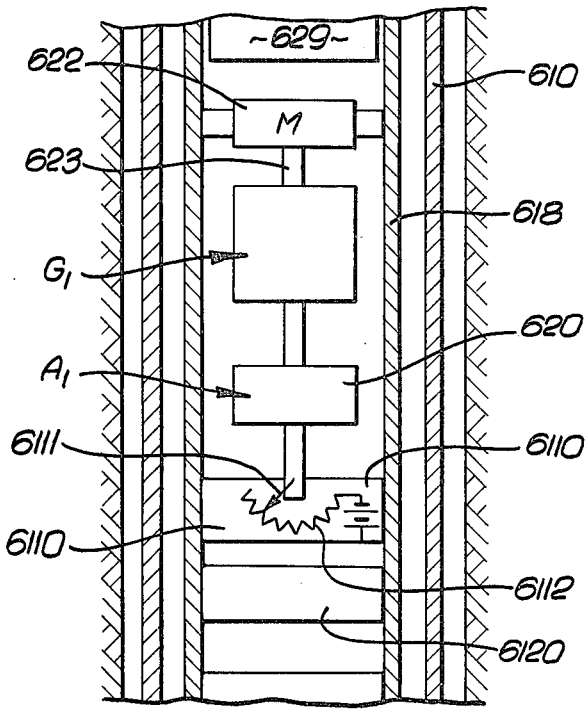
Figure 7:
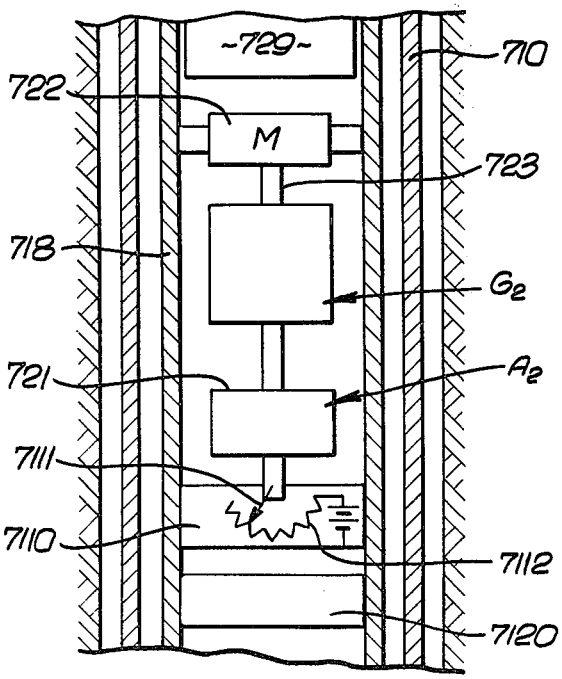
Figure 8:
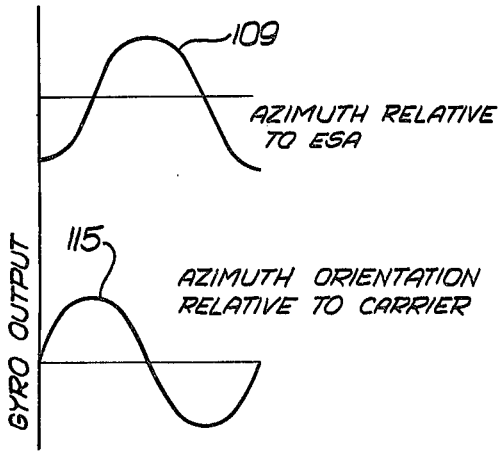

FIG. 4*a* is a diagrammatic representation of the $G_1$ accelerometer in FIG. 4;

FIG. 4*b* is a quadrant diagram;

FIG. 5 is a diagrammatic showing of the operation of one ($G_2$) of the two accelerometers of FIG. 1, under instrument tilted conditions;

FIG. 6 is a view like FIG. 1 showing a modification in which one of the gyrocompasses of FIG. 4 is used;

FIG. 7 is a view like FIG. 1 showing a modification in which the other of the gyrocompasses of FIG. 4 is used; and FIG. 8 is a wave form diagram.

DETAILED DESCRIPTION

In FIG. 1, well tubing 10 extends downwardly in a well 11, which may or may not be cased. Extending within the tubing in a well mapping instrument or apparatus 12 for determining the direction of tilt, from vertical, of the well or bore-hole. Such apparatus may readily be traveled up and down in the well, as by lifting and lowring of a cable 13 attached to the top 14 of the instrument. The upper end of the cable is turned at 15 and spooled at 16, where a suitable meter 17 may record the length of cable extending downwardly in the well, for logging purposes.

The apparatus 12 is shown to include a generally vertically elongated tubular housing or carrier 18 of diameter less than that of the tubing bore, so that well fluid in the tubing may readily pass, relatively, the instrument as it is lowered in the tubing. Also, the lower terminal of the housing may be tapered at 19, for assisting downward travel or penetration of the instrument through well liquid in the tubing. The carrier 18 supports first and second gyroscopes $G_1$ and $G_2$, and accelerometers 20 and 21, and drive means 22 to rotate the latter, for travel lengthwise in the well. Bowed springs 70 on the carrier center it in the tubing 10.

The drive means 22 may include an electric motor and speed reducer functioning to rotate a shaft 23 relatively slowly about a common axis 24 which is generally parallel to the length axis of the tubular carrier, i.e. axis 24 is vertical when the instrument is vertical, and axis 24 is tilted at the same angle from vertical as is the instrument when the latter bears sidewardly against the bore of the tubing 10 when such tubing assumes the same tilt angle due to bore-hole tilt from vertical. Merely as illustrative, the rate of rotation of shaft 23 may be within the range 0.5 RPM to 5 RPM. The motor and housing may be considered as within the scope of primary means to support and rotate the gyroscopes and accelerometers.

Due to rotation of the shaft 23, and lower extensions 23*a*, 23*b* and 23*c* thereof, the frames 25 and 125 of the gyroscopes and the frames 26 and 126 of the accelerometers are all rotated simultaneously about axis 24, within and relative to the sealed housing 18. The signal outputs of the gyroscopes and accelerometers are transmitted via terminals at suitable slip ring structures 25*a*, 125*a*, 26*a* and 126*a*, and via cables 27, 27*a*, 28 and 28*a*, to the processing circuitry at 29 within the instrument, such circuitry for example including a suitable amplifier or amplifiers, and multiplexing means, if desired. The multiplexed or non-multiplexed output from such circuitry is transmitted via a lead in cable 13 to a surface recorder, as for example includes pens 31–34 of a strip chart recorder 35, whose advancement may be synchronized with the lowering of the instrument in the well. The drivers 31*a*–34*a* for recorder pens 31–34 are calibrated to indicate bore-hole azimuth and degree of tilt, respectively, the run-out of the strip chart indicating bore-hole depth along its length.

Turning now to FIG. 4, the gyroscopes $G_1$ and $G_2$ are of compact, highly reliable construction, and each is characterized as having a spinning rotor or wheel (as at 36), and torsion structure defining an inner gimbal. Further, the rotor spin frequency has a predetermined relation to a resonant frequency of the torsion structure. For example, the rotor 36 is typically driven at high speed by synchronous motor 37, through the gimbal which includes mutually orthogonally extending primary and secondary torsion members 38 and 39, also schematically indicated in FIG. 4*a*. In this regard, motor rotary parts 40 transmit rotation to shaft 41 onto which a sleeve 42 is pressed. The sleeve is joined to arm 43 which is connected via radially extending torsion members 38 to ring 44. The latter is joined via torsion members 39 to the rotor or wheel 36. The rotor output axis (spin reference axis) is coincident with axis 24. In FIGS. 4 and 4*a* the axes and members of gyroscope $G_1$ are related as follows:

Y—direction input axis IA, defined by torsion members 39

X—direction input axis $IA_2$ defined by torsion members 38

Z—direction output axis $O_A$ (SRA) defined by shaft 41

Auxiliary elements of $G_1$ include a magnetic armature 45 affixed to the rotor 36 to rotate therewith; pick-offs 46 and 47 affixed to the case 48 (attached to frame 25) to extend closely beneath the rotor so as to be inductively activated by the armature as it rotates about the output axis $O_A$, (see pick-off coils 46*a* and 47*a*)and torque motors 49 and 50 affixed to the case. See the schematic of FIG. 4*b* which relates the positions of the torque motors and pick-offs to the armature, in quadrant relationship. The torque motors enable precessional torques to be applied to the rotor, via armature 45, on axes $IA_1$, and $IA_2$, which enable use of the gyro as a precision rate gyro.

The construction is such that the need for ball bearings associated with gimbaling of the rotor is eliminated, and the overall size of the gyroscope is reduced, and its output accuracy enhanced. The speed of rotation of the rotor and the torsion characteristics of the members 38 and 39 are preferably such as to provide a "tuned" or resonant dynamic relationship so that the rotor behaves like a free gyro in space. In addition, the angular position of the wheel relative to the housing (i.e. about axes $IA_1$ and $IA_2$) is detected by the two orthogonal pick-offs (thus to the extent the rotor tends to tilt about axis $IA_2$ toward one pick-off, its output is increased, for example, and to the extent the rotor tends to tilt about axis $IA_1$ toward the other pick-off its output is increased, for example). Therefore, gimbaling of the rotor is accurately sensed, as the gyroscope $G_1$ and its frame 25 are rotated about axis 24 by motor 22.

The FIG. 4 gyroscope $G_2$ is shown as having the same construction as $G_1$; however axes $IA_1$, $IA_2$ and $O_A$ of the two gyros are related as shown by the schematically orthogonal arrow groups 53 and 54 in FIG. 4. Thus, the output axis of the first gyro $G_1$ extends parallel to the one axis 24 which is the axis of rotation of the frames 25 and 125 produced by motor 22; and the output axis of the second gyro $G_2$ is normal to axis 24. The pick-offs 46 and 47 provide means to detect rotor pivoting about at least one, and preferably either, of the input axes $IA_1$ and $IA_2$, in response to such rotation of the gyroscope frame, for each gyro.

Figure 3:
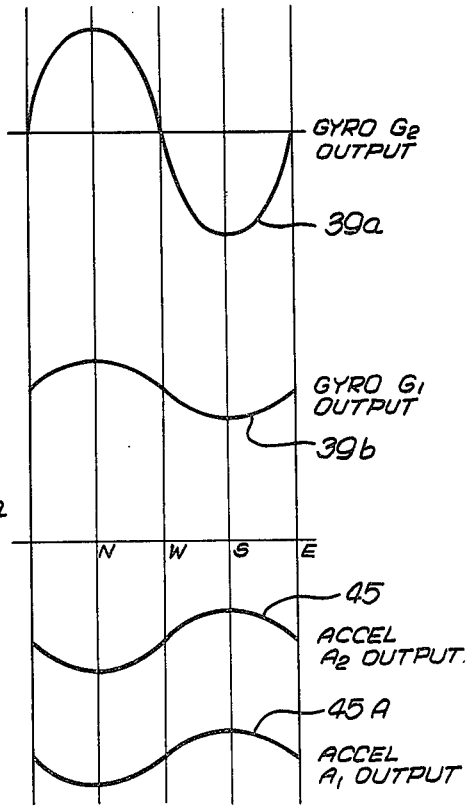
FIG. 3 is a wave form diagram.

Accordingly, the outputs from the two gyros provide information which enables a "double check", or redundancy, as to azimuth relative to the instrument case of housing. Turning to FIG. 3, as the gyroscope $G_2$ is rotated about axis 24, its signal output 39*a*, as detected by pick-off 47, is maximized when its spin reference axis SRA passes through the North-South longitudinal plane, and is least when that SRA axis is closest to being normal to that plane. As the other gyroscope $G_1$ is rotated about axis 24, its signal output 39*b*, as detected by its pick-off 47, is maximized when its SRA axis passes through the North-South longitudinal plane, and is least when that SRA axis is closest to being normal to the plane. Thus, for a non-vertical bore-hole, the two gyros will have outputs, and depending upon the latitude of the bore-hole, the two outputs will vary; however, they will tend to confirm each other, one or the other providing a stronger output. One usable gyroscope is Model GAM-1, a product of Societe de Fabrication de Instruments de Mesure, 13 Av. M. Ramolfo-Garner 91301 Massy, France.

Further, although each gyroscope $G_1$ and $G_2$ is a "two-axis" gyro (i.e. capable of rotation about either axis $IA_1$, and $IA_2$) it can be operated as a single degree of freedom gyro (i.e. made rotatable as described about only one of the axes $IA_1$ and $IA_2$) through use of the torque motors. Thus, if for $G_2$ the torque motor 49 is operated to magnetically interact with the armature 45 so as to effectively block gimbaling about axis $IA_2$, the rotor will only respond about axis $IA_1$ as the frame 125 is rotated about the axis 24, and the pick-off 47 will provide the desired output, as described. In the same way, if for $G_1$ its torque motor 49 is operated to block gimbaling about its $IA_2$, its rotor will only respond about its axis $IA_1$, as its frame 25 is rotated about axis 24, and pick-off 47 will provide the above described output.

Figure 2:
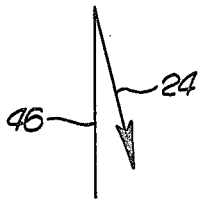
FIG. 2 is a diagram indicating tilt of the well mapping tool in a slanted well.

The accelerometer 21, which is simultaneously rotated with the gyroscope, has an output as represented for example at 45 in FIG. 3 under tilted conditions corresponding to tilt of axis 24 in North-South longitudinal plane; i.e., the accelerometer output is maximized when the $G_2$ gyroscope output indicates South alignment, and again maximized when the gyroscope output indicates North alignment. FIG. 2 shows tilt of axis 24 from vertical 46, and in the North-South plane, for example. Further, the accelerometer maximum output is a function of the degree of such tilt, i.e., is higher when the tilt angle increases, and vice versa; therefore, the combined outputs of the gyroscope and accelerometer enable ascertainment of the azimuthal direction of bore-hole tilt, at any depth measured lengthwise of the bore-hole and the degree of that tilt. The operation of accelerometer 20 is the same as that of 21, and is shown at 45*a* in FIG. 3, both being rotated by motor M at the same rate.

FIG. 5 diagrammatically illustrates the functioning of either accelerometer in terms of rotation of a mass 40 about axis 24 tilted at angle $\phi$ from vertical 46. As the mass rotates through points 144 at the level of the intersection of axis 24 and vertical 146, its rate of change of velocity in a vertical direction is zero; however, as the mass rotates through points 147 and 148 at the lowest and highest levels of its excursion, its rate of change of velocity in a vertical direction is at a maximum, that rate being a function of the tilt angle $\phi$. A suitable accelerometer is that known as Model 4303, a product of Systron-Donner Corporation, of Concord, California.

Control of the angular rate of rotation of shaft 23 about axis 24 may be from surface control equipment indicated at 50, and circuitry 29 connected at 80 with the motor. Means (as for example a rotary table 81) to rotate the drill pipe 10 during well mapping, as described, is shown in FIG. 1.

Referring to FIGS. 1 and 8 either gyroscope is characterized as producing an output which varies as a function of azimuth orientation of the gyroscope relative to the earth's spin axis, that output for example being indicated at 109 in FIG. 8 and peaking when North is indicated. Shaft 23 may be considered as a motor rotary output element which may transmit continuous unidirectional drive to the gyroscopes. Alternatively, the shaft may transmit cyclically reversing rotary drive to the gyroscopes. Further, the structure 22 may be considered as including servo means responsive to the gyroscope output to control the shaft 23 so as to maintain the gyroscopes with predetermined azimuth orientation, i.e. the output axis of gyroscope $G_2$ for example may be maintained with direction such that the output 109 in FIG. 8 remains at a maximum or any other desired level.

Also shown in FIG. 1 is circuitry 110, which may be characterized as a position pick-off, for referencing the gyroscope outputs to the case or housing 18. Thus, that circuitry may be connected with the motor (as by wiper 111 on shaft 23*d* turning with the gyroscope frames 25 and 125 and with shaft 23), and also connected with the carrier 18 (as by slide wire resistance 112 integrally attached to the carrier) to produce an output signal at terminal 114 indicating azimuthal orientation of the gyroscopes relative to the carrier. That output also appears at 115 in FIG. 8. As a result, the output at terminal 114 may be processed (as by surface means generally shown at 116 connected to the instrumentation by cable 13) to determine or derive azimuthal data indicating orientation of the carrier or housing 18 relative to the earth's spin axis. Such information is often required, as where it is desired to know the orientation of well logging apparatus being run in the well.

In this regard, each gyro produces an output as reflected in its gimbaling, which varies as a function of azimuth orientation of the gyro relative to the earth's spin axis. The position pick-off, in referencing the gyroscope to the frame (25 or 125), produces an output signal at the pick-off terminal indicating azimuthal orientation of the gyro relative to the carrier or frame.

Item 120 in FIG. 1 may be considered, for example, as well logging apparatus the output of which appears at 121. Carrier 18 supports item 120, as shown. Merely for purpose of illustration, such apparatus may comprise an inclinometer to indicate the inclination of the bore-hole from vertical, or a radiometer to sense radiation intensity in the hole.

It will be understood that the recorder apparatus may be at the instrument location in the hole, or at the surface, or any other location. Also, the control of the motor 29 may be pre-programmed or automated in some desired manner.

FIGS. 6 and 7 show the separate and individual use of the gyroscopes $G_1$ and $G_2$ (i.e. not together) in combination with drive motors 622 an 722, and accelerometers or tilt sensitive devices 620 and 721, respectively. Other elements corresponding to those in FIG. 1 bear the same numbers but are preceded by a 6 or 7, as respects FIGS. 6 and 7. The operations of the gyroscopes $G_1$ and $G_2$ in FIGS. 6 and 7 are the same as described in FIG. 1.

In FIG. 4, stops 150 on shafts 41 limit rotor gimbaling relative to the shafts, stops, pick-offs and torque motors.

The invention also contemplates relative rotation of the gyroscope rotor and of the pick-offs and torque motors, about the gyroscope output axis; thus, the drive motor 22 may rotate a platform mounting the pick-offs and torque motors, about the output (SRA) axis of the rotor, such rotation being relative to the rotor.

I claim:

1. In mapping apparatus, the combination comprising:

(a) a gyroscope and a carrier frame therefor, and primary means including a housing supporting the gyroscope and carrier frame for lengthwise travel along a travel axis extending lengthwise of a bore hole, (b) the gyroscope characterized as having a spinning rotor and torsion structure defining a gimbal, and wherein the rotor spin frequency has a predetermined relation to a resonant frequency of said structure, (c) the gyroscope further characterized as having two input axes, and an output axis about which the spin rotor rotates, said output axis extending generally in the direction of said travel axis, (d) drive means operatively connected with said frame to rotate the frame about one of said axes, and (e) the gyroscope having means to detect rotor pivoting about one of said two input axes in response to said rotation of the frame.

2. The combination of claim 1 wherein the gyroscope frame is rotated about said output axis by the drive means.

3. The combination of claim 1 wherein the gyroscope frame is rotated about one of said input axes by the drive means.

4. The combination of claim 1 wherein said two input axes extend generally normal to said one axis,.

5. The combination of claim 1 wherein the gyroscope includes torque motor means and the rotor includes armature means to magnetically interact with said means to block gimbaling about the other of said two input axes.

6. The combination of claim 5 wherein said housing also supports and contains said drive means which comprises a drive motor.

7. The combination of claim 1 wherein said means to detect rotor pivoting includes circuitry for producing an output which varies as a function of azimuth orientation of said output axis relative to the earth's spin axis.

8. The combination of claim 1 including a tilt sensing device associated with the gyroscope to be rotated in conjunction with said rotation of the gyroscope carrier frame, and to produce an output which varies as a function of said rotation of the gyroscope carrier frame and of tilt thereof from vertical.

9. The combination of claim 7 including a tilt sensing device associated with the gyroscope to be rotated in conjunction with said rotation of the gyroscope carrier frame, and to produce an output which varies as a function of said rotation of the gyroscope carrier frame and of tilt thereof from vertical.

10. The combination of claim 5 wherein said housing is suspended within a bore-hole in the earth to be traveled lengthwise of said hole.

11. The combination of claim 1 wherein the gyroscope includes a motor to rotate the spinning rotor, and said torsion structure includes mutually orthogonally extending primary and secondary torsion members through which rotation is transmitted from the motor to the rotor, said primary and secondary members defining said two input axes.

12. In mapping apparatus, the combination comprising (a) a first gyroscope and a first frame therefor, and a second gyroscope and a second frame therefor, (b) each of the two gyroscopes characterized as having a spinning rotor and torsion structure defining a gimbal, and wherein the rotor spin frequency has a predetermined relation to a resonant frequency of such structure, (c) each gyroscope further characterized having two input axes and an output axis about which the spin rotor rotates, said axes orthogonally related, (d) drive means operatively connected with the gyroscope frames to rotate the frames about axes which are orthogonally related relative to the gyroscopes, the output axis of the first gyroscope extending orthogonally relative to the output axis of the second gyroscope, (e) each gyroscope having means to detect rotor pivoting about one of said two input axes in response to said rotation of the gyroscope frame.

13. The combination of claim 12 wherein said frames of the two gyroscope are interconnected to be simultaneously rotated about the same axis by the drive means.

14. The combination of claim 12 wherein each gyroscope includes a motor to rotate the spinning rotor, and said torsion structure includes mutually orthogonally extending primary and secondary torsion members through which rotation is transmitted from the motor to the rotor, said primary and secondary torsion members defining said two input axes.

15. The combination of claim 12 including primary means supporting the gyroscopes and carrier frames for lengthwise travel along a travel axis which is parallel to said one axis.

16. The combination of claim 15 wherein said primary means includes a housing supporting and containing said gyroscopes and carrier frames, and each gyroscope includes means to block gimballing about the other of said two input axes.

17. The combination of claim 16 wherein said housing also supports and contains said drive means which comprises a drive motor.

18. The combination of claim 12 wherein said means to detect rotor pivoting includes circuitry for producing an output which varies as a function of azimuth orientation of said output axis relative to the earth's spin axis.

19. The combination of claim 1 including tilt sensing apparatus associated with the gyroscopes to be rotated in conjunction with said rotation of the gyroscope carrier frames, and to produce an output which varies as a function of said rotation of the gyroscope carrier frames and of tilt thereof from vertical.

20. The combination of claim 18 including a tilt sensing device associated with the gyroscope to be rotated in conjunction with said rotation of the gyroscope carrier frame, and to produce an output which varies as a function of said rotation of the gyroscope carrier frame and of tilt thereof from vertical.

21. The apparatus of claim 20 wherein said tilt sensing apparatus includes two tilt sensing devices arranged to sense tilt about respective orthogonal axes.

22. The combination of claim 16 wherein said housing is suspended within a bore-hole in the earth to be traveled lengthwise of said hole.

23. In the method of mapping a remote zone, the steps that include:

(a) suspending at said zone a gyroscope and a housing therefor, the gyroscope characterized as having a spinning rotor and torsion structure defining a gimbal, the rotor spin frequency having a predetermined relation to a resonant frequency of said structure, the housing having a travel axis, (b) the gyroscope further characterized as having two input axes and an output axis about which the spin rotor rotates, the gyroscope also having a carrier frame, said suspending carried out to locate said output axis in the generaly direction of said travel axis, (c) rotating the carrier frame about said output axis, and (d) detecting rotor pivoting about one of said two input axes in response to said rotation of the frame to produce a signal as a function of azimuth orientation of said output axis relative to the earth's spin axis.

24. The method of claim 23 including also suspending at said zone a tilt sensing device and rotating said device in conjunction with said rotation of the gyroscope carrier frame thereby to produce signals indicative of degree of tilt of said zone from vertical.

25. The method of claim 24 wherein said zone is located in a bore-hole, and including the step of intermittently traveling said housing, said gyroscope and said tilt sensitive device lengthwise of said bore-hole, and to different of said zones therein.

26. The method of mapping a remote zone, the steps that include:

(a) suspending at said zone first and second gyroscopes each characterized as having a spinning rotor and torsion structure defining a gimbal, the rotor spin frequency having a predetermined relation to a resonant frequency of such structure, (b) such gyroscope further characterized as having two input axes and an output axis about which the spin rotor rotates, each gyroscope also having a carrier frame, (c) rotating the carrier frame of each gyroscope about one of the gyroscope axes, the suspension of the gyroscopes being such that the output axis of the first gyroscope extends parallel to said one axis and the output axis of the second gyroscope extends normal to said one axis, (d) and, for each gyroscope, detector rotor pivoting about one of the two input axes in response to said rotation of the carrier frame.

27. The method of claim 26 wherein said rotation of the carrier frames is carried out simultaneously and at the same angular rate, and also about a common axis of rotation.

28. The method of claim 27 wherein said detection is carried out to produce, for each gyroscope, a signal as a function of azimuth orientation of the gyroscope output axis relative to the earth's spin axis, and including also suspending at said zone a tilt sensitive apparatus and rotating said apparatus in conjunction with said rotation of the gyroscope frames thereby to produce signals indicative of degree of tilt of said zone from vertical.

29. The method of claim 23 including substantially blocking rotor pivoting about the other of said input axes during said rotor pivoting about the one input axis.

30. The method of claim 26 including, for each gyroscope, substantially blocking rotor pivoting about the other of said input axes during said rotor pivoting about the one input axis.

31. The combination of claim 11 wherein the gyroscope includes means to effect blocking of rotor pivoting about the other of said input axes during said rotor pivoting about said one input axis.

32. The combination of claim 14 wherein each gyroscope includes means to effect blocking of rotor pivoting about the other of said input axes during said rotor pivoting about said one input axis.

33. In mapping apparatus, the combination comprising (a) a first gyroscope and a first frame therefor, and a second gyroscope and a second frame therefor, (b) each of the two gyroscopes characterized as having a spinning rotor and a gimbal, (c) each gyroscope further characterized having two input axes and an output axis about which the spin rotor rotates, said axes orthogonally related, (d) drive means operatively connected with the gyroscope frames to simultaneously rotate each frame about one of said axes, the output axis of the first gyroscope extending parallel to said one axis, and the output axis of the second gyroscope extending normal to said one axis, (e) each gyroscope having means to detect rotor pivoting about one of said two input axes in response to said rotation of the gyroscope frame.

34. The combination of claim 33 wherein said frames of the two gyroscopes are interconnected to be simultaneously rotated about said one axis by the drive means, a housing for said gyroscopes and drive means, and means to travel said housing lengthwise in a bore-hole.

35. In mapping apparatus, the combination comprising (a) a first gyroscope and a first frame therefor, and a second gyroscope and a second frame therefor, (b) each of the two gyroscopes characterized as having a spinning rotor and a gimbal, (c) each gyroscope further characterized having two input axes and an output axis about which the spin rotor rotates, said axes orthogonally related, (d) drive means operatively connected with the gyroscope frames to simultaneously rotate each frame about one of said axis, the output axis of the first gyroscope having a component extending parallel to said one axis, and the output axis of the second gyroscope having a component extending normal to said one axis, (e) such gyroscope having means to detect rotor pivoting about one of said two input axes in response to said rotation of the gyroscope frame.

36. The combination of claim 35 wherein said frames of the two gyroscopes are interconnected to be simultaneously rotated about said one axis by the drive means, a housing for said gyroscopes and drive means, and means to travel said housing lengthwise in a bore-hole.

37. In mapping apparatus, the combination comprising:

(a) a gyroscope and a carrier frame therefor, and a housing for said gyroscope and carrier frame, the housing adapted to be suspended in a bore hole for lengthwise travel therealong, (b) the gyroscope characterized as having a spinning rotor and torsion structure defining a gimbal, and wherein the rotor spin frequency has a predetermined relation to a resonant frequency of said structure, (c) the gyroscope further characterized as having two input axes, and an output axis about which the spin rotor rotates, (d) drive means operatively connected with said frame to rotate the frame about one of said axes, (e) the gyroscope having means to detect rotor pivoting about one of said two input axes in response to said rotation of the frame, (f) the gyroscope including a motor to rotate the spinning rotor and said torsion structure including mutually orthogonally extending primary and secondary torsion members through which rotation is transmitted from the motor to the rotor, said primary and secondary members defining said two input axes, (g) the gyroscope including means to block gimbaling about the other of said input axes.

* * * * *